United States Patent [19]

Broquet et al.

[11] Patent Number: 4,791,803

[45] Date of Patent: Dec. 20, 1988

[54] DIE-CHANGE DEVICE FOR A MULTI-STAGE FORMING MACHINE

[75] Inventors: Joseph Broquet, Wahlen, Switzerland; Raymond Schoenenberger, Rosenau, France

[73] Assignee: Hatebur Umformmaschinen AG, Switzerland

[21] Appl. No.: 930,339

[22] Filed: Nov. 12, 1986

[30] Foreign Application Priority Data

Nov. 28, 1985 [CH] Switzerland ..... 5089/85

[51] Int. Cl.[4] ..... B21D 37/04

[52] U.S. Cl. ..... 72/481; 72/472; 72/404; 72/446; 72/354

[58] Field of Search ..... 72/481, 472, 446, 352, 72/354, 358, 448, 404

[56] References Cited

U.S. PATENT DOCUMENTS 3,002,479 10/1971 Johansen .
3,559,446 2/1971 Dom .
4,238,950 12/1980 Carrieri et al. ..... 72/446

FOREIGN PATENT DOCUMENTS 1177935 9/1964 Fed. Rep. of Germany .
1966879 2/1975 Fed. Rep. of Germany .
2740617 3/1979 Fed. Rep. of Germany .
220522 4/1985 Fed. Rep. of Germany ..... 72/481
50733 5/1981 Japan ..... 72/481
573281 3/1976 Switzerland .

OTHER PUBLICATIONS

Schnellwechseln von Stanzwerkzeugen von Dr.-Ing. R. Dies, pp. 63-66, Jan. 1961.

*Primary Examiner*—David Jones
*Attorney, Agent, or Firm*—Ladas & Parry

[57] ABSTRACT

In a multi-stage forming machine, a die-change device, for male dies in a male-die block has a mounting plate for receiving a clamping face of the male-die block on one side. Bayonet fasteners on hollow pistons in the mounting plate then engage the male dies, and a pressure medium then moves the hollow pistons to move the male dies against thrust pieces displacably in the hollow pistons and the thrust pieces against an adjusting wedge on the opposite side of the mounting plate.

6 Claims, 5 Drawing Sheets

DIE-CHANGE DEVICE FOR A MULTI-STAGE FORMING MACHINE

Figure 1:
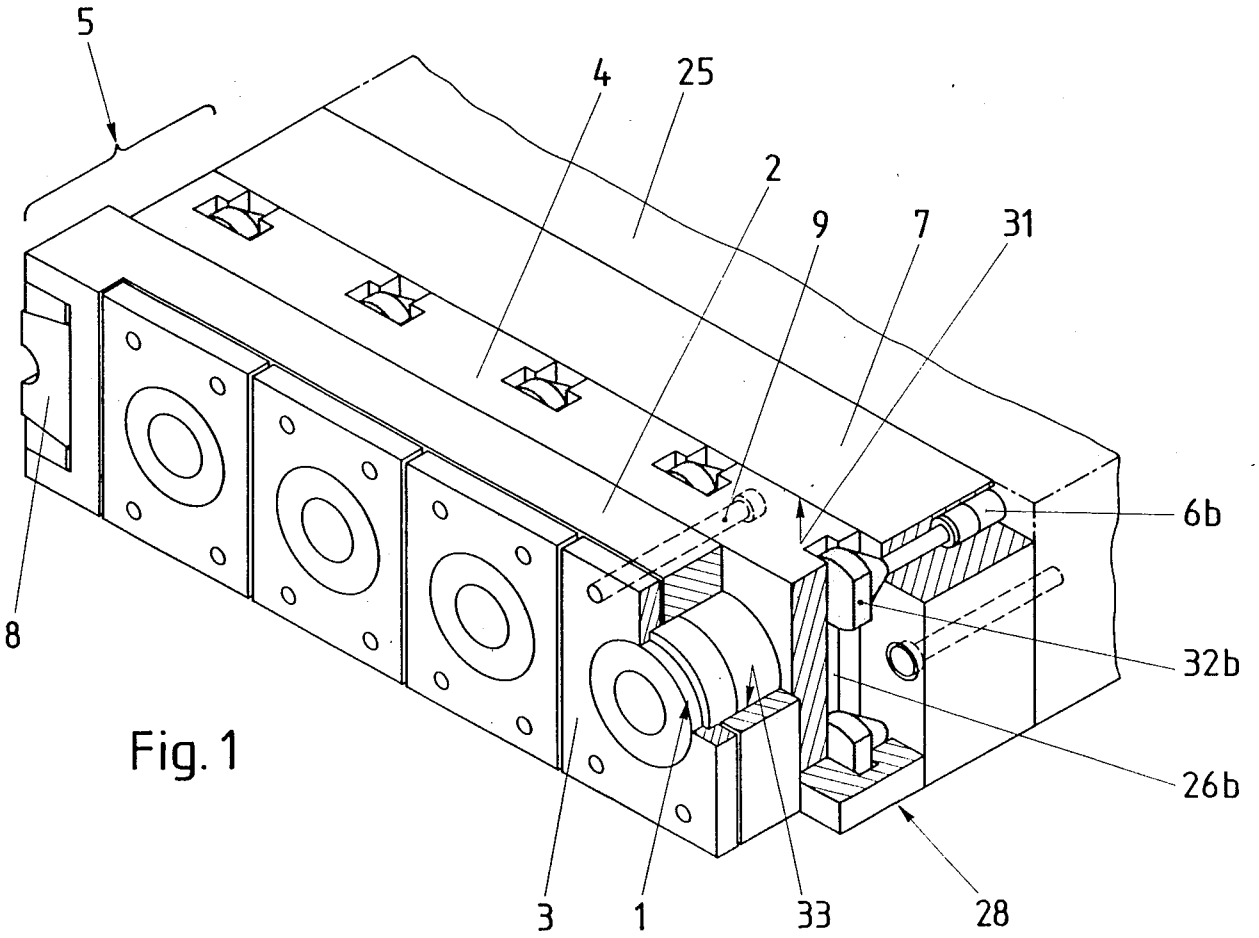

The invention relates to a die-change device.

The main purpose of a device of this type is to allow male and female dies in a die space of a forming machine to be exchanged as quickly as possible, so that the corresponding change-over times, which make it necessary to stop the machine can be kept as short as possible.

In known devices of this type, the dies are fastened in die-change mountings, which sometimes have to be exchanged and braced individually within the die space of the forming machine. This work, which occasionally entails a large amount of force, has to be carried out within the frequently-confined die space and with the body in an uncomfortable position, with the result that it is often difficult to ensure reliable, uniform bracing of all the die mountings or sets sets. At all events, a die change carried out in the known way requires relatively long change-over times during which the machine must be stopped. Partial automation is obtained in known die-change devices if clamping screws are loosened and tightened with a special device. However, since a relatively long time is still taken up in actuating all the fastening elements with this device, only a negligible time saving is achieved.

It is known from German patent publication No. 1,966,879 and U.S. Pat. No. 3,559,446 to mount dies for a forming machine an anvil and mounting plate of a holding device for the forming machine. Although, with this known arrangement, a certain time saving is obtained in comparison with die-change systems in which the dies have to be installed in the die space individually nevertheless, the arrangement requires the same, lengthy adjustment and bracing of the latter die-change systems during installation in the forming machine, so that, overall, only a slight reduction in the idle time of the forming machine is obtained.

A further disadvantage of the above and other known die-change arrangements is that the dies are mounted in the die holders without being braced. After prolonged operation, this leads relatively frequently to increased wear of the die mountings and to settling of the die. This results in such increasing play between the die holder and forming machine that it can no longer be compensated for during operation. A resulting loosening of the bracing of the die holder relative to the forming machine or, more particularly, a press slide thereof can often be detected only when damage or even destruction of the die, or the die interacting therewith has already occurred.

The object of the invention is, therefore, to provide a die-change device in which the dies can be mounted outside the die space of the forming machine for rapid automatic or semi-automatic change in the forming machine in a way which promises low-wear operation, makes it possible to exchange both the male dies and the female dies without difficulty in a short, centrally-controllable time, and assures reliable adjustment of the dies.

The manner in which this object is achieved according to the invention is defined, in particular, hereinafter. In brief, a multi-stage forming machine for non-cutting shaping of metal, for example, with cooperative male and female dies has clamping devices for clamping male-die and female-die blocks into the forming machine. The male-die block clamping device has a mounting plate for receiving the male-die block on one side. An adjusting wedge is on the opposite side of the mounting plate. Coupling and clamping elements in the mounting plate clamp the male-die block to the one side of the mounting plate and couple or join to the dies therein for moving the male dies against the coupling elements and the coupling elements against the adjusting wedge.

For both of the male-die and female-die blocks, the clamping elements are pressure-actuated pistons in the forming machine which engage T-shaped slots in the male-die and female-die blocks to pull these into the forming machine.

Because the male and female dies are arranged according to the invention in die blocks in the manner of change magazines, these can be made ready for use outside the machine, so that the idle time of the machine necessary for the die change only lasts for the duration of the exchange of the die block.

In the method according to the invention for clamping the die blocks on the female-die side and on the male-die side, the clamping elements are located in the corresponding clamping parts on the press-slide side or on the machine-body side and project from these only with piston-head portions of the piston/cylinder units actuated by a pressure medium; these head portions can be inserted into T-slots cut out perpendicularly to the row of respective dies in the particular die block to be exchanged, and the die blocks can then be clamped against the pressure faces on the machine-body side and on the press-slide side, when the clamping elements are appropriately subjected to the pressure medium. The displacement of the piston-head portions between a die-block release position, in which the block can be taken out of the tool space vertically relative to the stroke direction of the press slide, and a position clamping the particular die block ready for use is effected from a central control desk via appropriate pressure-medium control devices, preferably a hydraulic control. To achieve high pressing forces, the piston/cylinder units can be designed as tandem cylinders in order to obtain smaller piston diameters.

In addition to the clamping elements, during the exchange of the die block, centering elements actuable by a pressure medium likewise remain in the clamping parts located on the machine-body side and on the press-slide side and can engage with matching piston portions in centering recesses provided in the clamping face of the particular die block. These centering elements can be actuated from the central control desk. Via an appropriate pressure-medium control device, preferably likewise a hydraulic control, the clamping of the die blocks by the clamping elements together with the insertion of the piston portions of the centering elements into the matching centering recesses can be controlled in such a way that a correct positioning of the entire particular die block is carried out automatically during the clamping of the die block. The centering and adjusting accuracy achieved thereby is so high that there is no need for separate alignment of the male and female dies relative to one another in the horizontal and vertical direction.

In the die-change device according to the invention, there is between the male-die block and the press slide a male-die bracing device with coupling and clamping elements which are each aligned with the longitudinal center axes of the male dies and which make a non-positive play-free connection between the male dies on the one hand and the press slide on the other hand. These coupling and clamping elements grip the respective male dies in their rear end portions via a releasable bayonet fastening arranged in the region of the parting plane of the male-die block and press these male dies against the press-slide front under the control of a pressure medium via a thrust piece located between the press slide and the male-die end. Because of the pressing force of the press-slide front, generated according to the pressure exerted, any play at the male dies and between these and the press slide is prevented. The pressing force of the male dies against the press-slide front, maintained and, if appropriate, monitored during operation, ensures, in each position of the respective machine parts, that bearing conditions which cannot be obtained in conventional die-clamping devices are achieved. In the device according to the invention, deformation or settling of the loaded die parts, which occurs in conventional devices and which has an effect on the clamping force of the connecting elements, is compensated because the particular male dies are subjected to a constant pressure by the pressure medium, or wear phenomena of this type cannot even occur at all. It can therefore be seen that the male-die bracing device of the die-change device according to the invention makes a big contribution to reducing the wear of all the dies. Via a pressure monitor installed in the pressure-medium circuit of the male-die bracing device, the pressing force of the bracing device can be monitored during continuous operation or can be checked by corresponding safety means which stops the machine below a predetermined minimum pressure and which indicates the nature of the fault.

Figure 2:
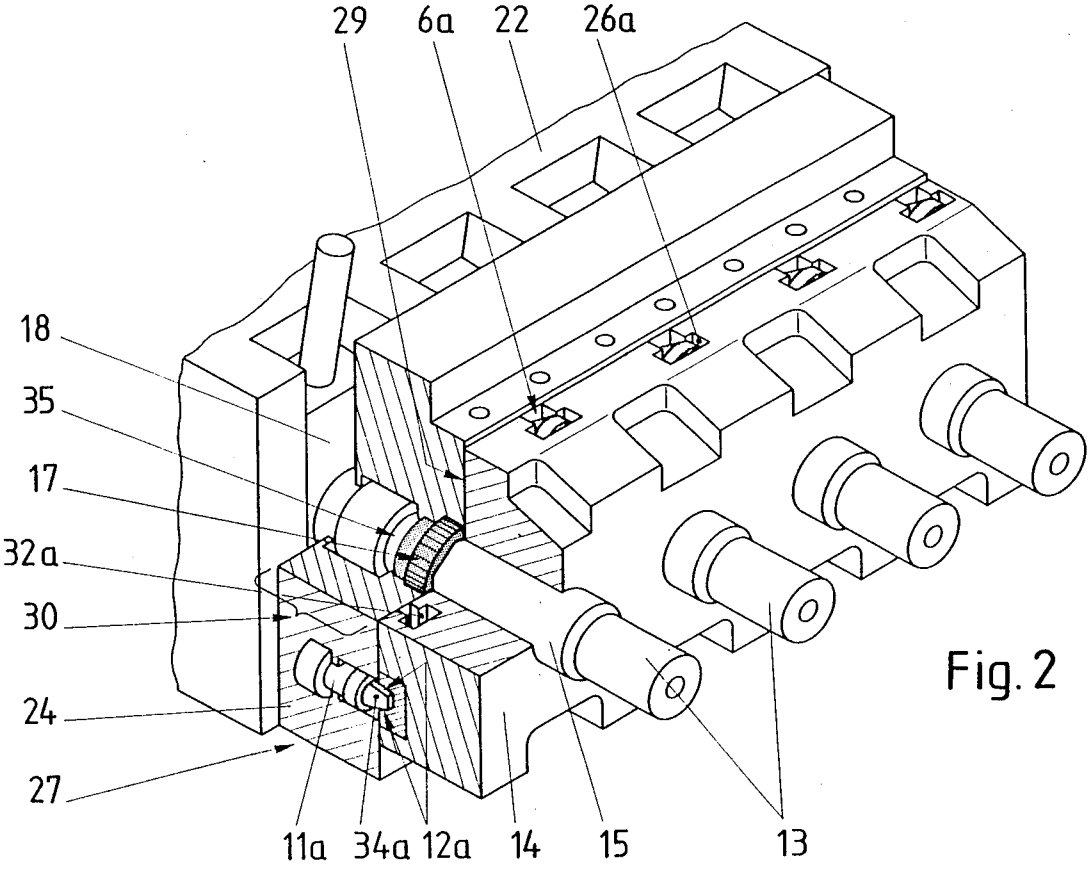
Figure 3:
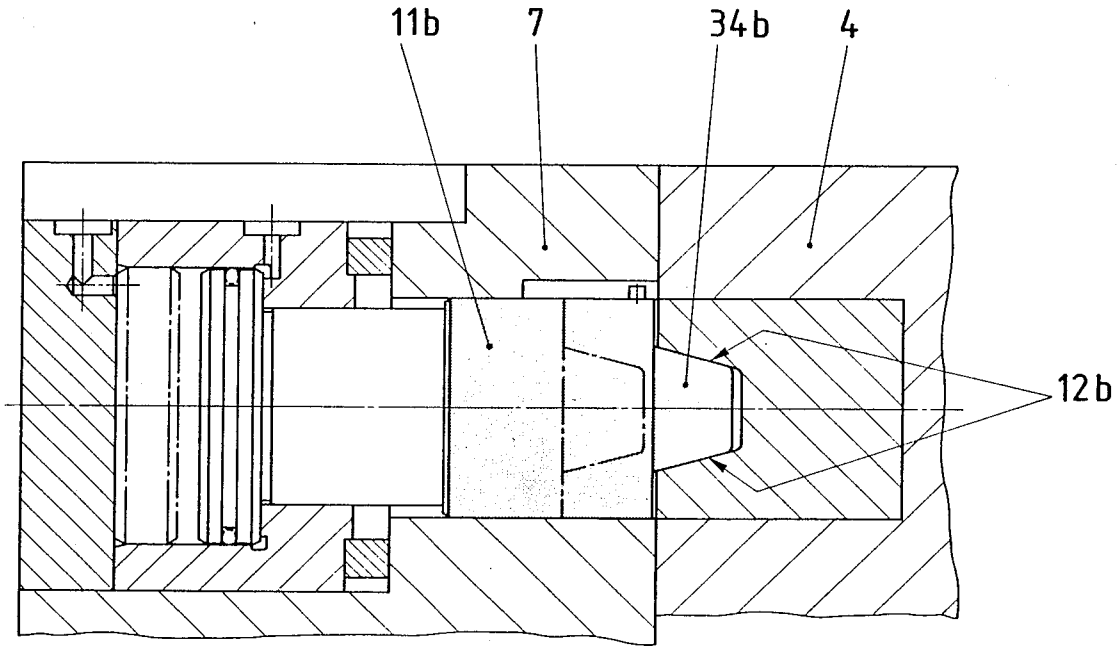
Figure 4:
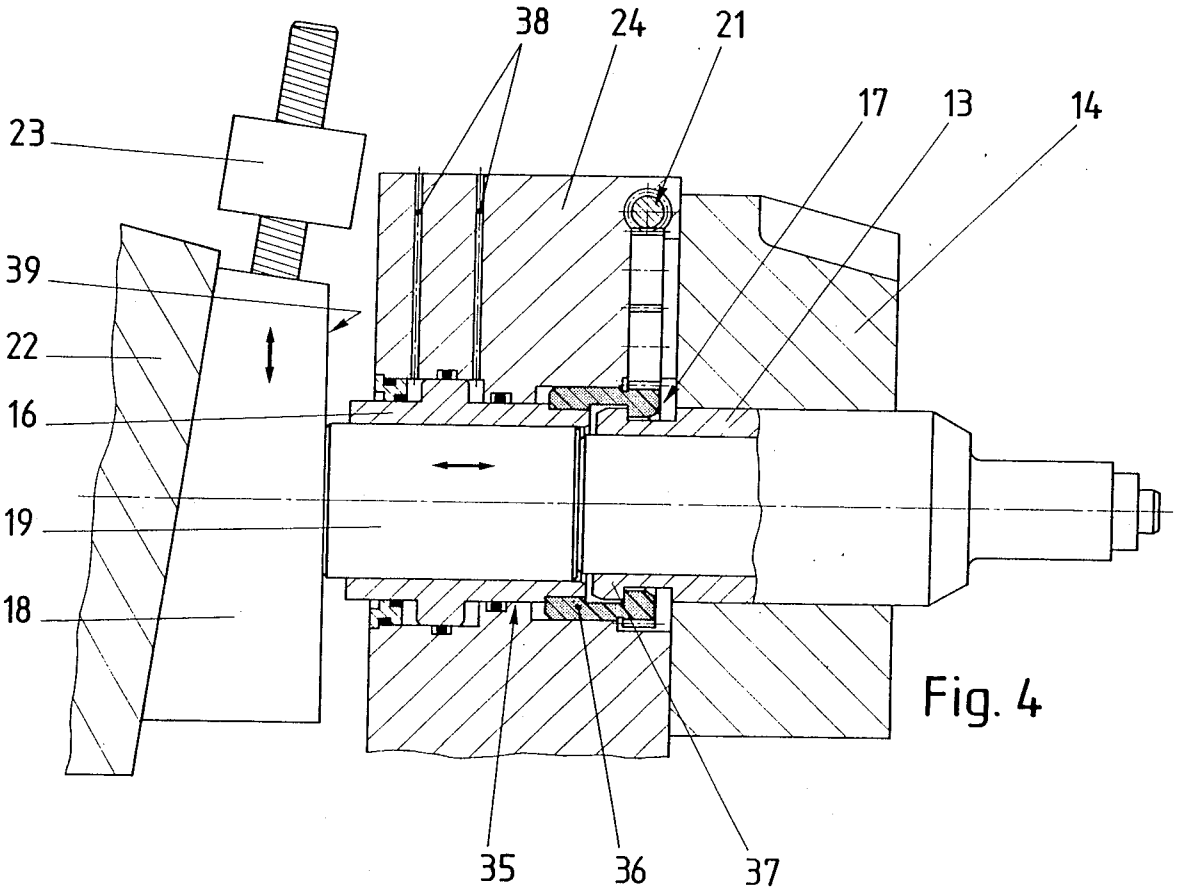
Figure 5A:
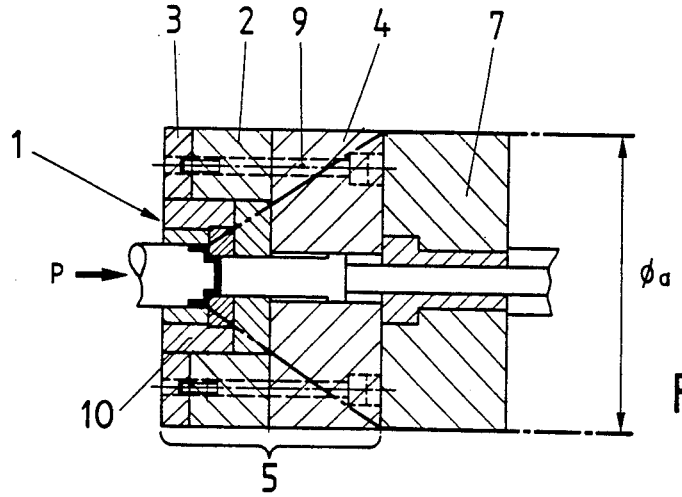
Figure 5A:
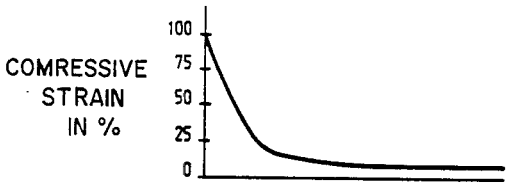
Figure 5B:
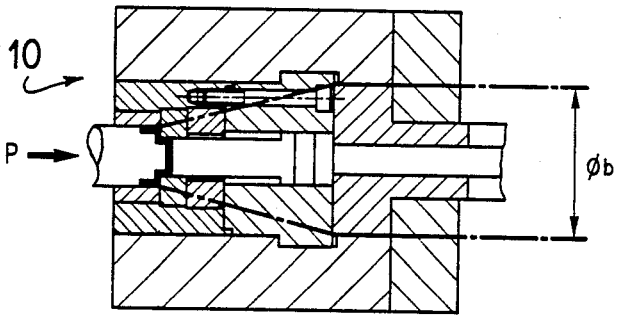
Figure 5B:
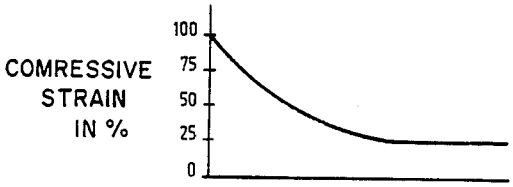

Further details and functional relationships emerge from the following description of an exemplary embodiment of the die-change device according to the invention, with reference to drawings in which:

FIG. 1 is a perspective view, partly cut away and in section, of a female-die block portion of a forming machine according to the invention, FIG. 2 is a perspective view, partly cut away and in section, of a male-die block portion of a forming machine according to the invention, FIG. 3 shows a diagrammatic sectional representation of a centering device, FIG. 4 shows a diagrammatic sectional view of a male-die bracing device, FIG. 5*a* shows a diagrammatic sectional representation through a female-die block fastened to the machine body via a clamping plate, with the section taken through the longitudinal center axis of a female die to illustrate the qualitative compressive stress curve under press force, FIG. 5*b* shows a diagrammatic representation corresponding to that of FIG. 5*a*, to illustrate the qualitative compressive stress curve under press force in conventional female dies constructed with the use of an anvil, and FIGS. 5*a*' and 5*b*' show the corresponding compressive stress curves.

A female-die block at 5 in FIG. 1 has a centering plate 2, which peripherally supports female dies 1 in receiving bores at 33 (only one shown) so that a row of individual female dies is formed for successive forming stages. In the end portion of the centering plate 2 on the left in FIG. 1 is a bar knife 8 which serves for severing blanks to be processed in the dies. Individual clamping collars 3 are attached to respective female dies 1 at the front side of the die block 5 and are each provided with four threaded bores in their corner regions. Attached to the opposite, rear side of the centering plate 2, facing away from the clamping collars 3, is an adaptor plate 4 which supports the female dies 1 at their rear end. In the sectional representation according to FIG. 5*a*, it can be seen that the adaptor plate 4 provides a relatively large-area support for the female dies 1 in comparison with the representation in FIG. 5*b*. Four clamping screws 9 for each clamping collar 3 are inserted from the rear side of the adaptor plate and clamp together the entire female-die block to form a die unit which is ready for installation and which, as a whole, has only a small constructional depth.

As is also evident from FIG. 5*a*, the positioning of the clamping screws 9 in the corner regions of the clamping collars 3 makes it possible to use a shrink ring 10 which can be made without weakening threaded bores and substantially shorter than in the conventional female-die sets according to FIG. 5*b*. The enlargement of the die parts located behind the female dies 1, which is possible in the female-die block 5 according to FIG. 5*a*, results in a generally favorable compressive stress curve within the female-die support, since larger receiving surfaces that in conventional female-die sets are available for absorbing the particular press forces. The press-force curve to be expected in each example is marked by dot-and-dash lines in FIGS. 5*a* and 5*b* and is given as $\phi a$ and $\phi b$ respectively. This diameter designation relates to the particular pressure-absorbing part which is in direct contact with the respective female-die set. The diagrams of the compressive stress curves under press force, given in the two figures, make it possible to draw appropriate conclusions as to the particular die wear to be expected and the material stress.

The front of a forming machine body at 25 (indicated diagrammatically in FIG. 1) carries is a clamping plate 7, on which the female-die block 5 can be clamped by means of its adaptor plate 4, on a mounting face 31 extending transversely relative to the longitudinal center axes of the female dies. The entire assembled unit constitutes the die-change mounting 28. In order to clamp the die block 5 on the clamping plate 7, in the example illustrated, five T-slots 26*b* extending perpendicularly to the row of female dies 1 are cut out in the adaptor plate 4. Correspondingly shaped piston-head portions 32*b* engage into these slots 26*b* and form the piston ends of hydraulically actuated piston/cylinder units(clamping elements 6*b*). According to FIG. 1, two clamping elements 6*b* are provided in the clamping plate 7 for each slot 26*b*. It is evident from the drawing that, when the clamping elements 6*b* are released, the die block 5 can be removed from the clamping plate 7 at right angles to the axis of the row of female dies 1. A transport mechanism (not shown) can be provided for appropriately transporting away a female-die block removed in this way. The clamping elements 6*b* are connected to a central hydraulic arrangement, and the displacement of their pistons can be controlled from a central control desk.

In addition to the advantage of rapid release of the female-die block 5 from the clamping plate 7 by appropriate actuation of the clamping elements 6*b*, their use also offers the further advantage that wear, which can never be eleminated completely and a resulting play between the female-die holder 5 and the mounting face of the clamping plate 7, are compensated practically at their very origin by the clamping elements which are under pressure during operation. It can therefore be said that a pressing force of the clamping elements 6b which is maintained at a constant level ensures that, when the machine parts meet one another, bearing conditions comparable to those occurring when the machine is new are always produced. It is also possible to install pressure monitors in the hydraulic circuit supplying pressure to the clamping elements 6b, so that in this way the pressing force can be checked or monitored via a safety arrangement and, in the event of a fault, its cause indicated.

According to FIG. 2, the male dies 13 are mounted in guiding bushes 15 in a row of receiving bores in a male-die block 14 and guided in bushes 15. In a way corresponding completely to the female-die block, there are cut out in a clamping face 29 of this die block 14, which extends transversely to the longitudinal center axes of the male dies, T-slots 26a, which extend perpendicularly to the row of male dies 13 and into which engage correspondingly shaped piston-head portions 32a of clamping elements 6a, of which the piston/cylinder units actuable by a pressure medium are accommodated in a mounting plate 24 of a male-die bracing device 30. The bracing device 30 forms a die-change mounting at 27 which is on the male-die side of the forming machine, in front of a press slide 22.

FIG. 2 also shows an hydraulically-actuable centering element 11a which, in the female-die block 5 according to FIG. 1, is provided in a corresponding way between the clamping plate 7 and the adaptor plate 4, as shown in detail in FIG. 3. These center the die blocks 5 and 14 on their mounting faces in the vertical and horizontal directions during the clamping operation. The centering element 11b which can be seen in FIG. 3 is accommodated in the clamping plate 7 and has an hydraulically-actuable piston, the piston portion 34b of which is shaped conically, so that it can engage into conical surfaces of centering recesses 12b in the adaptor plate 4. These hydraulically actuable centering elements 11a and 11b are actuated from the central control desk in synchronism with the clamping effect of the hydraulic clamping elements 6a and 6b, so that exact positioning takes place essentially simultaneously with the clamping. After hydraulic clamping elements 6a and 6b have been released, the centering elements 11a and 11b can, if desired, be kept engaged with their centering recesses 12a and 12b, until the vertical displacement of the particular die block is to take place, for example in an exchange, in order thereby to make it possible reliably to prevent a premature displacement of the die block already released. At least two centering elements are necessary for each die block.

According to FIG. 2, the male-die bracing device at 30 has a mounting plate 24 having a side receiving the clamping face 29 of the male-die block 14 and an opposite side. The mounting plate has a row of coupling and clamping elements 35, which extend between the opposite sides, through the mounting plate 24, and are aligned with the respective longitudinal center axes of the male dies. These make a non-positive play-free connection between the male dies 13 and the press slide 22. According to FIG. 4, hollow pistons 16 of the coupling and clamping elements 35 are each equipped at one end, at the side of the mounting plate 24 receiving the clamping face 29 of the male-die block 14, with a bayonet fastening 17 comprising a connecting sleeve 36 which can be joined together with a sleeve counterpiece 37 provided in the respective rear end portion of a male die 13. The hollow piston 16 is guided within the mounting plate 24 so as to be relatively displaceable axially of the longitudinal center axis of the corresponding make die and between the opposite sides of the mounting plate 24 under the control of a pressure medium circuit 38. It has, in its inner, hollow region, a correspondingly relatively displaceable thrust piece 19, one axial end of which rests against the rear end of the male die 13 and the opposite end, against a supporting face 39 of an adjusting wedge 18 of the forming machine, which is guided in the press slide 22 so as to be vertically displaceable, i.e. in its wedge direction, when the pressure circuit 38 moves the hollow piston axially away from the side of the mounting plate 24 receiving the clamping face 29 of the male-die block. When, according to the illustration in FIG. 4, the hollow piston 16 is shifted to the right in the direction of the marked double arrow via the pressure-medium circuit 38 (hydraulic channels), with the bayonet fastening 17 closed, the respective male die is simultaneously shifted in this direction, as a result of which the die 13 is pressed against the adjusting wedge 18 and consequently against the front of the press slide 22 according to the hydraulic pressure exerted on the hollow piston 16. When the hydraulic pressure on the hollow piston 16 is maintained, practically all play between the male die and the press-slide front is eliminated.

The adjusting wedge 18 which can be seen in FIG. 4 serves for the axial adjustment of the male dies. For this purpose, the hollow piston 16 has to be made pressureless, so that the thrust piece 19 can be displaced inside it depending on the vertical, i.e. wedge direction, adjustment of the wedge 18 relative to the mounting plate 24. For the remote actuation of the wedge adjustment, there is, shown diagrammatically in FIG. 4, a motor drive 23 which via a threaded spindle can execute a desired vertical displacement of the adjusting wedge 18. This drive 23 can also be activated from the central control desk. After the axial adjustment of the male die 13 has been carried out, the hollow piston can be put under pressure again in the way described, in order to obtain axial bracing. A pressure monitor can also be installed in the pressure-medium circuit 38 of the hollow piston 16, so that the clamping pressure of the hollow piston can be monitored.

To exchange the male-die block 14, in addition to the release of the clamping elements 6a which has already been described it is also necessary to open the bayonet fastening 17 between the particular male die 13 and the male-die bracing device 30. This purpose is served by a rotary drive 21 which is indicated merely diagrammatically in FIG. 4 and which, likewise controlled centrally, can rotate all the male dies 13 until the sleeve parts 36, 37 can be drawn apart from one another. When the bayonet fastenings 17 are drawn apart in this way, the male dies 13 are moved to the left according to FIG. 4, until their rear ends have emerged from the region of the hollow piston 16 and the male-die block 14, guided via the T-slots 26a, can be lifted out of the die space in the vertical direction. This displacement of the male-die block 14 can be carried out by hand or by means of a suitable lifting and transport mechanism (not shown), if appropriate also controlled remotely.

In addition to the above-described advantages of the die-block design on the female-die side and on the male-die side, the fundamental reshaping and automation according to the invention of the tool space of forming machines provide a die-block quick-change system which decisively widens the production possibilities of forming machines of this type. Because of the rapid change-over, even small series can now be produced in a favorable way, since as a result of the novel construction of the die blocks and the low-wear clamping method the die service life exceeds the time taken to produce the series, and consequently it has become unnecessary to exchange worn dies, which would necessarily result in a machine stoppage. It is precisely the relatively long change-over times customary on conventional forming machines which made the production of small series so expensive. However, in addition to these production-related advantages, the working conditions with regard to the die space are also improved, since it is possible to change a die block without a large amount of force being exerted. Also, because less time is taken up in changing a die block, sufficient free time remains for it to be possible, for example, to check other equipment on the forming machine and, if appropriate, exchange it.

We claim:

1. In a multi-stage forming machine for non-cutting shaping with cooperative male and female dies (13, 1 respectively) having respective longitudinal center axes, the male and female dies being in rows in respective male-die and female-die blocks, (14, 5), the forming machine having clamping means for clamping the male-die and female-die blocks (14, 5) into the forming machine, the improvement in the clamping means for clamping the male-die block (14) into the forming machine, comprising:

a mounting plate (24) mounted on the forming machine and having one side for receiving a clamping face (29) of the male-die block (14), an opposite side, and coupling and clamping element means (35) respectively aligned with the longitudinal center axes of the male dies (13) when the clamping face (29) of the male-die block (14) is received on the one side of the mounting plate (24), each coupling and clamping element means (35) comprising:

a hollow piston (16) guided through the mounting plate (24) for axial relative displacement away from the one side of the mounting plate (24), and having one end at the one side of the mounting plate (24);

pressure-medium means (38) in the mounting plate (24) for so relatively displacing the hollow piston (16);

bayonet fastening means (17) comprising a connecting sleeve (36) on the one end of the hollow piston (16) for joining the hollow piston (16) to a sleeve counterpiece (37) on one, rear end of the male die (13) at the clamping face (29) of the male-die block (14);

an adjusting wedge (18) at the opposite side of the mounting plate (24) displaceable relative to the mounting plate (24) in the wedge direction thereof; and a thrust piece (19) relatively displaceable in the hollow piston (16) in a direction corresponding to the relative displacement of the hollow piston (16) for engaging the one, rear end of the male die (13) at one end and the adjusting wedge at the opposite end when the bayonet fastening means (17) is joined to the sleeve counterpiece (37) of the male die (13) and the pressure medium means (38) has displaced the hollow piston (16) away from the one side of the mounting plate (24).

2. A die-change device as claimed in claim 1, and further comprising a rotary drive (21) on the mounting plate (24) for simultaneous rotation of all the male dies (13) in the male-die block (14) when received on the one side of the mounting plate (24) and, thereby, opening and closing the bayonet fastening means (17).

3. A die-change device as claimed in claim 1, and further comprising a remotely-acutable drive (23) for the wedge-direction displacement of the adjusting wedge (18).

4. A die-change device as claimed in claim 1, and further comprising a pressure monitor in the pressure-medium means (38) for controlling the displacement of the hollow piston (16) and an alarm signal device responsive to the pressure-medium means (38) when the pressure thereof is too low.

5. A die-change device as claimed in claim 1, and further comprising clamping means (6*a*) in the mounting plate (24), the clamping means (6*a*) having piston-head portions (32*a*) at the clamping face (29) of the mounting plate (24) for engaging correspondingly-shaped T-slots (26*a*) in the male-die block (14) at the clamping face (29) thereof when the male-die block (14) is received on the one side of the mounting plate (24) and extending perpendicularly to the row of the male dies (13) in the male-die block 14, each clamping means (6*a*) having a cylinder unit for actuating the piston-head portion (32*a*) thereof with a pressure medium; and centering means (11*a*) in the mounting plate (24) comprising piston portions (34*a*) projectable from the one side of the mounting plate (24) by a pressure medium for engaging in the clamping face (29) of the male-die block (14) when received on the one side of the mounting plate (24).

6. A die-change device as claimed in claim 5, wherein there are cut out in the female-die cassette block (5), on the same side as the clamping face of the adaptor plate (4), several T-slots (26*b*) which extend perpendicularly to the row of female dies (1) and into which can be inserted correspondingly shaped piston-head portions (32*b*) of clamping elements (6*b*) which are arranged in the clamping plate (7) opposite the T-slots and which each consist of a piston/cylinder unit actuable by a pressure medium, and wherein in the mounting face (31) there are also at least two centering recesses (12*b*), into which can be inserted matching piston portions (34*b*) of centering elements (11*b*) which are arranged in the said clamping plate (7) and which are likewise actuable by a pressure medium.

* * * * *